United States Patent [19]

Kosodo et al.

[11] 4,256,439

[45] Mar. 17, 1981

[54] POWER CONTROL SYSTEM FOR MULTIPLE PUMPS

[75] Inventors: Hiroshi Kosodo; Heiji Tomotsugu; Hiroshi Kudo, all of Yokohama, Japan

[73] Assignee: The Japan Steel Works Ltd., Tokyo, Japan

[21] Appl. No.: 76,909

[22] Filed: Sep. 19, 1979

[30] Foreign Application Priority Data

Nov. 20, 1978 [JP] Japan ..... 53/143614

[51] Int. Cl.[3] ..... F04B 49/08

[52] U.S. Cl. ..... 417/216; 60/430; 60/486

[58] Field of Search ..... 417/216, 286, 218, 269; 60/428, 430, 445, 452, 486

[56] References Cited

U.S. PATENT DOCUMENTS

| | | | |
|---|---|---|---|
| 3,440,965 | 4/1969 | Raymond | 417/269 X |
| 3,841,795 | 10/1974 | Ferre et al. | 60/486 X |
| 3,924,971 | 12/1975 | Jacquot | 60/486 X |
| 4,065,228 | 12/1977 | McMillan | 417/216 X |
| 4,212,596 | 7/1980 | Ruseff | 417/216 |

FOREIGN PATENT DOCUMENTS

| | | | |
|---|---|---|---|
| 2521055 | 11/1975 | Fed. Rep. of Germany | 417/216 |
| 54-108905 | 8/1979 | Japan | 417/216 |
| 55-1478 | 1/1980 | Japan | 417/216 |

*Primary Examiner*—Carlton R. Croyle
*Assistant Examiner*—Edward Look

[57] ABSTRACT

According to the invention, there is provided a power control system designed to effectively utilize the output power of an engine with the aid of a simple tilt control device, even if any of the pumps are operated under a no load condition. The control system comprises a pressure selector valve with the output pressures of two variable volume pumps of the same capacity being fed thereto, the lower output pressure being selected by the selector valve and introduced to a pilot portion of a tilt control of at least one of the other variable volume pumps, the output pressure of which is fed either directly or through another pressure selector valve to a pilot portion of at least one of the variable volume pumps of the same capacity, thereby controlling the power of the multiple pumps.

11 Claims, 15 Drawing Figures

POWER CONTROL SYSTEM FOR MULTIPLE PUMPS

BACKGROUND OF THE INVENTION

This invention relates generally to pumps and control systems therefor and more particularly to a power control systemt for multiple pumps of the variable volume type that are driven by a single engine with at least two of the pumps having the same capacity.

Although hydraulically powered vehicles utilizing hydraulic pumps to operate hydraulic actuators are widely used in construction and other types of machinery, the improvement of their control system is required because recently the number of hydraulic pumps has tended to increase.

Accordingly, the present invention provides a power control system with a high efficiency which is necessary for controlling multiple pumps of the variable volume type that are driven by a single engine.

The reason for this will now be explained hereunder. Considering a case where three pumps are involved, for an example: even though the tilt control is combined with known circuitry, it is made necessary to change the pilot portion of the tilt control in FIG. 8*a* to the one having a stepped plunger as shown in FIG. 8*b*, providing two pilot ports thereto and feeding the output pressure of other pumps respectively to said pilot ports. Therefore, the steps of pilot plunger and, accordingly, the number of pilot ports must be increased as the number of pumps increases, resulting in the disadvantages that the structure of tilt control becomes complex and the number of man hours for plumbing increases thereby.

Further, this control system using a multi-stepped pilot plunger basically works satisfactorily with all pumps operated under loaded condition, but limits the usable power for operating pumps at a lower power than the maximum power of an engine when any other pump is under a no load condition.

In other words, there is a drawback in that, as any pump operating at constant power puts out higher pressure, the usable power for other pumps is reduced.

SUMMARY OF INVENTION

Several objects of the present invention are to eliminate the disadvantages aforementioned, to simply dispose the tilt controls without complicating its structure and to increase usable power from an engine when any pump is driven unloaded.

In order to achieve these objects, a power control system for multiple pumps is provided, comprising a pressure selector valve, to which the output pressure of two variable volume pumps of the same capacity are fed, the lower output pressure selectively picked up be the selector valve being routed to a pilot portion of a tilt control of at least one of the other variable volume pumps, and at the same time, the output pressure of the other variable volume pumps being fed either directly or through another pressure selector valve to a pilot portion of at least one of the variable volume pumps of the same capacity.

DESCRIPTION OF THE PREFERRED EMBODIMENTS

The details of the present invention will now be explained referring to the accompanying drawings.

Figure 1:
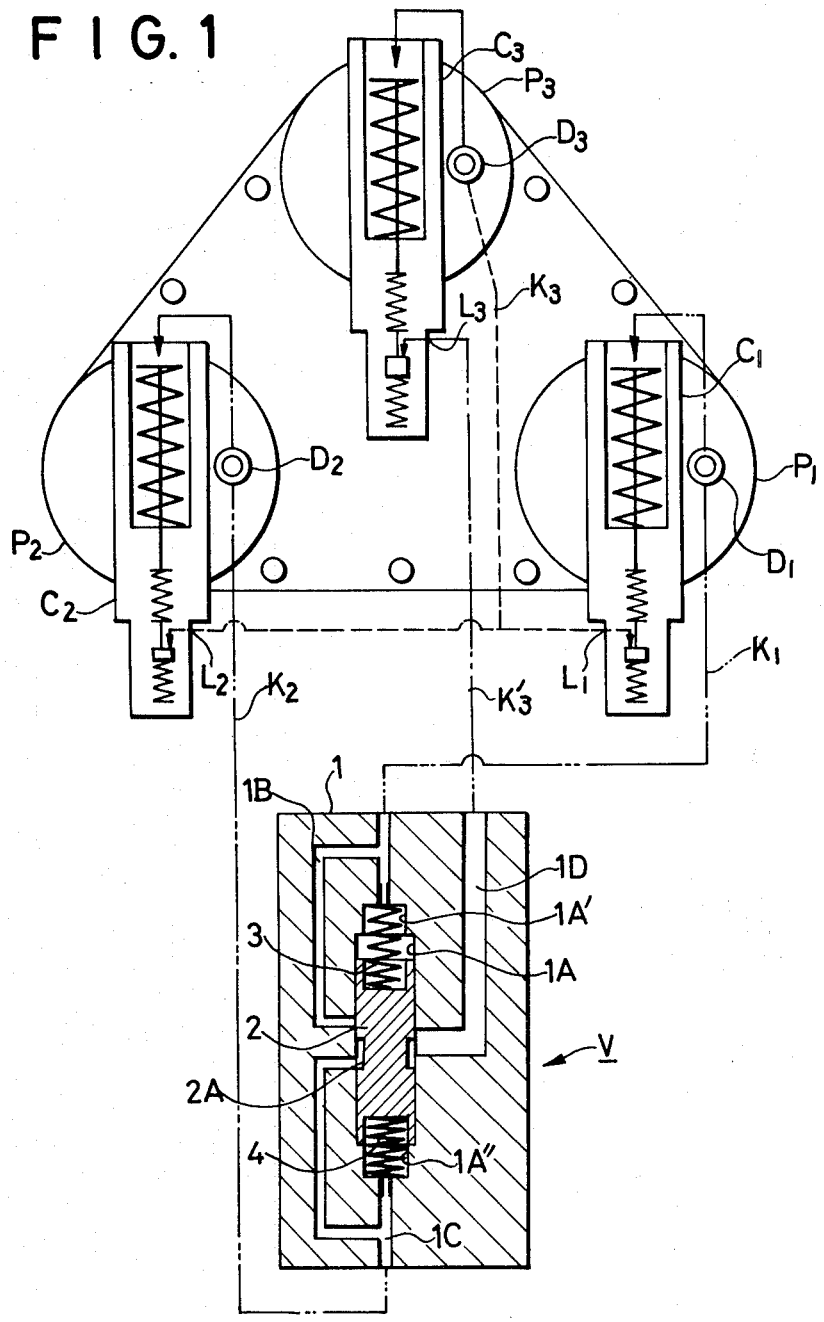
FIG. 1 is a schematic view, partially in section, of a portion of a system comprising the present invention.

In FIG. 1, the reference characters $P_1$, $P_2$ and $P_3$ designate variable volume pumps with $P_1$ and $P_2$ having the same capacity.

Reference characters $C_1$, $C_2$ and $C_3$ designate tilt controls, details of which are to be discussed later.

Reference character V refer to a pressure selector valve in the body of which a pressure chamber 1A is formed and in which a spool 2 having a slot 2A on its intermediate peripheral surface is slidably positioned. At the upper and lower ends of the pressure chamber 1A are formed the upper chamber 1A' and the lower chamber 1A" and compression springs 3 and 4 are, respectively, installed. With the spool 2 in the upper position (opposite to that shown in FIG. 1), the upper chamber 1A' is connected through the channel 1B to the slot 2A while with the spool 2 in the lower position as shown in FIG. 1, the lower chamber 1A" is connected through the channel 1C to the slot 2A. With the spool 2 in approximately a neutral position, the slot 2A is connected to both channels 1B and 1C. The slot 2A is exposed to the channel 1D with the spool in any position.

The outlet port $D_1$ of the pump $P_1$ is connected through the tubing $K_1$ to the channel 1B, and the outlet port $D_2$ of the pump $P_2$ is connected through the tubing $K_2$ to the channel 1C.

The outlet port $D_3$ of the pump $P_3$ is connected through the tubing $K_3$ to the pilot ports $L_1$ and $L_2$ of the tilt controls $C_1$ and $C_2$ on the pumps $P_1$ and $P_2$, while said channel 1D in the pressure selector valve is connected through the tubing $K'_3$ to the pilot port $L_3$ of the tilt control $C_3$ on the pump $P_3$.

Figures 8A, 8B:
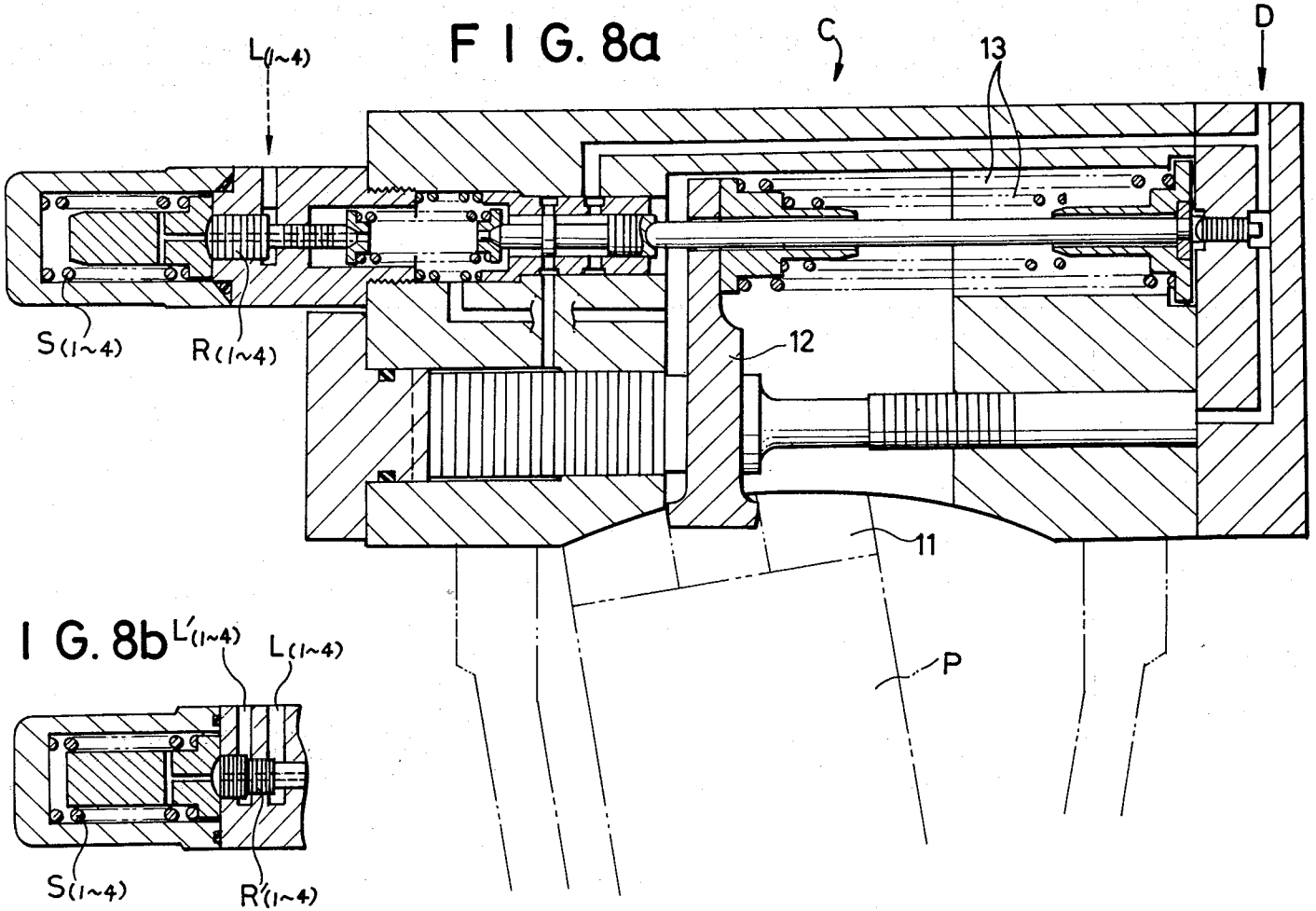
FIG. 8*a* is longitudinally-sectioned, side elevational view of a tilt control showing a stepless plunger type pilot portion.
FIG. 8*b* is a view similar to FIG. 8*a* showing a stepped plunger type pilot portion.

The tilt control C will now be explained, referring to FIG. 8*a*.

The slider of the pump P is designated by the reference character 11 the tilt control pin by the reference character 12 and the spring by the reference character 13.

The pilot port L is connected to a bore, wherein a plunger R is fitted, the plunger R being based by a spring S on the end thereof to counteract the pressure X fed through the pilot port L and applied against the face of the plunger R. FIG. 8*b* shows the pilot portion having two pilot ports L and $L_1$, the plunger R' being stepped to form two portions having different diameters, with each portion exposed to the pilot ports L and L', respectively.

Figure 2A:
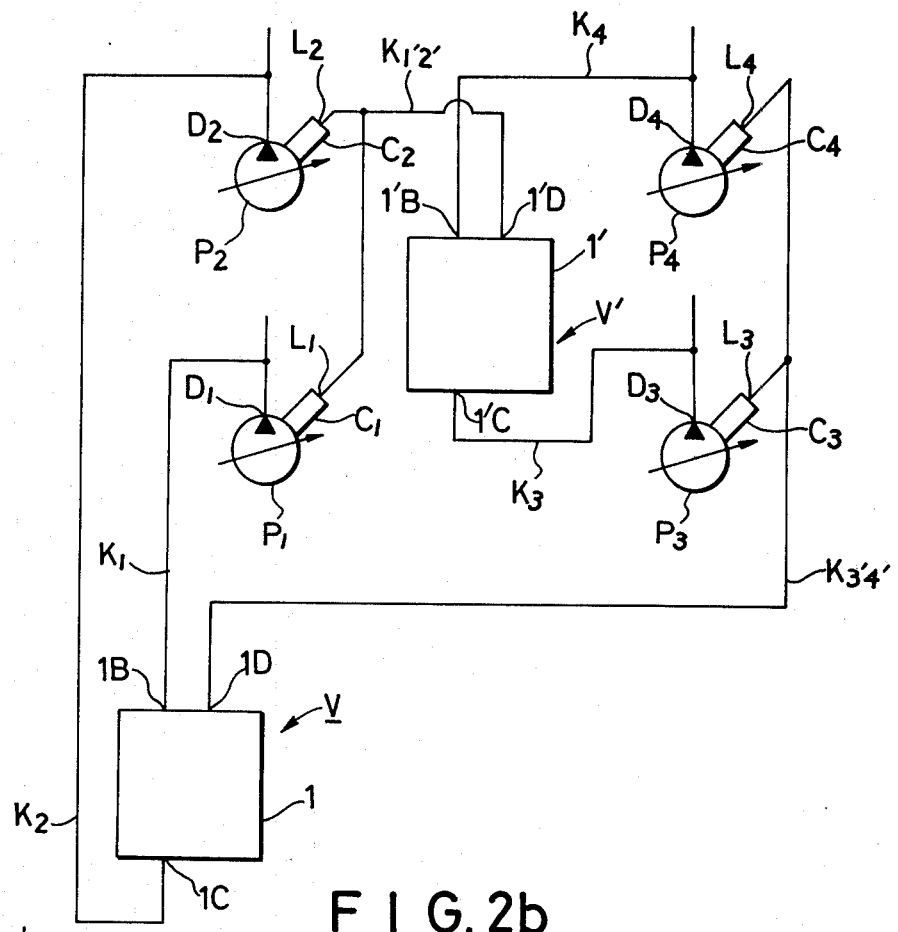
FIG. 2*a* is a schematic diagram of another example of the present invetnion.
Figure 2B:
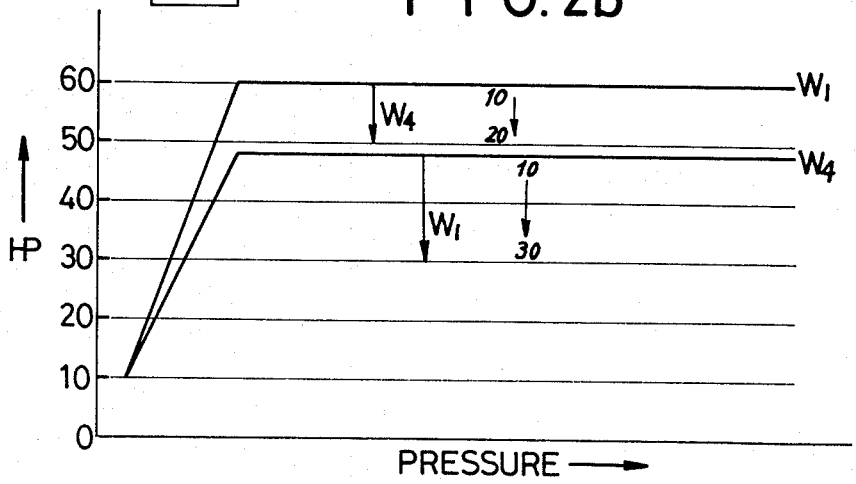
FIG. 2*b* is a graphical representation showing the relation between the limit power and the pressure of the system shown in FIG. 2*a*.

In the example in FIG. 2, four variable volume pumps $P_1$, $P_2$, $P_3$ and $P_4$ are provided, wherein the maximum capacity of the pumps $P_1$ and $P_2$ is same, while the maximum capacity of the pumps $P_3$ and $P_4$ is also same with two pressure selector valves V and V' being used. The outlet ports $D_1$ and $D_2$ of the pumps $P_1$ and $P_2$ are connected through the tubing $K_1$ and $K_2$ to the channels 1B and 1C in the pressure selector valve V respectively, and the outlet ports $D_3$ and $D_4$ of the pumps $P_3$ and $P_4$ are connected through the tubing $K_3$ and $K_4$ to the channels 1'B and 1'C in the pressure selector valve V' respectively.

The channel 1D of the pressure selector valve V is connected through the tubing $K_{3',4'}$ to the pilot ports $L_3$ and $L_4$ of the tilt controls $C_3$ and $C_4$ on the pumps $P_3$ and $P_4$ respectively.

The channel 1'D of the pressure selector valve V' is connected through the tubing $K_{1',2'}$ to the pilot ports $L_1$ and $L_2$ of the tilt controls $C_1$ and $C_2$ on the pumps $P_1$ and $P_2$ respectively.

Figure 3:
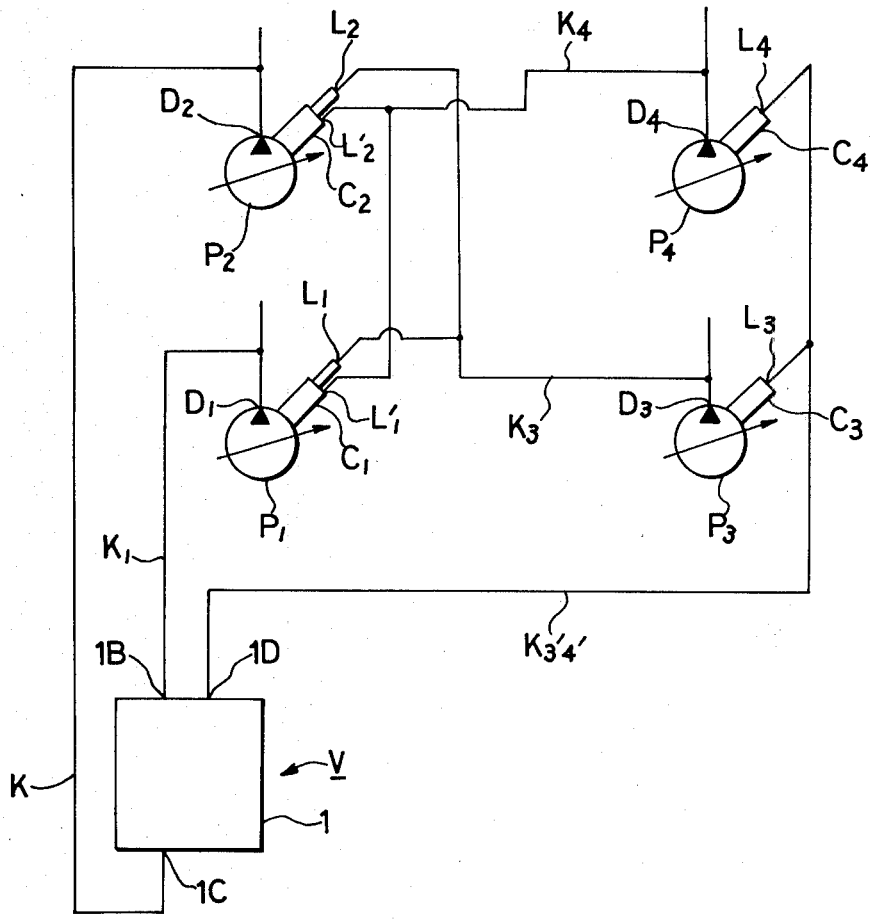
FIGS. 3 through 6 are schematic diagram of other examples of the invention.

In the example shown in FIG. 3, the maximum capacity of the variable volume pumps $P_1$ and $P_2$ is same, and similarly to the example in FIG. 2, the maximum capacity of the variable volume pumps $P_3$ and $P_4$ is also the same. However, the latter need not be same in this case. In this application, only one pressure selector valve V is used, but the pilot portions of the tilt controls $C_1$ and $C_2$ on the pump $P_1$ and $P_2$ are equipped with stepped plungers R' which are exposed to two pilot ports L and L' as shown in FIG. **8*b***.

Similarly to the example shown in FIG. 2, the outlet ports $D_1$ and $D_2$ of the pumps $P_1$ and $P_2$ are connected to the channels 1B and 1C of the pressure selector valve V respectively, and the channel 1D of the valve V is connected to the pilot ports $L_3$ and $L_4$ of the tilt controls $C_3$ and $C_4$ on the pumps $P_3$ and $P_4$ respectively. However, the outlet port $D_3$ of the pump $P_3$ is connected through the tubing $K_3$ to the first pilot ports $L_1$ and $L_2$ of the tilt controls $C_1$ and $C_2$ on the pumps $P_1$ and $P_2$, and the outlet port $D_4$ of the pump $P_4$ is connected to the second pilot ports $L'_1$ and $L'_2$ on the pumps $P_1$ and $P_2$.

Figure 4:
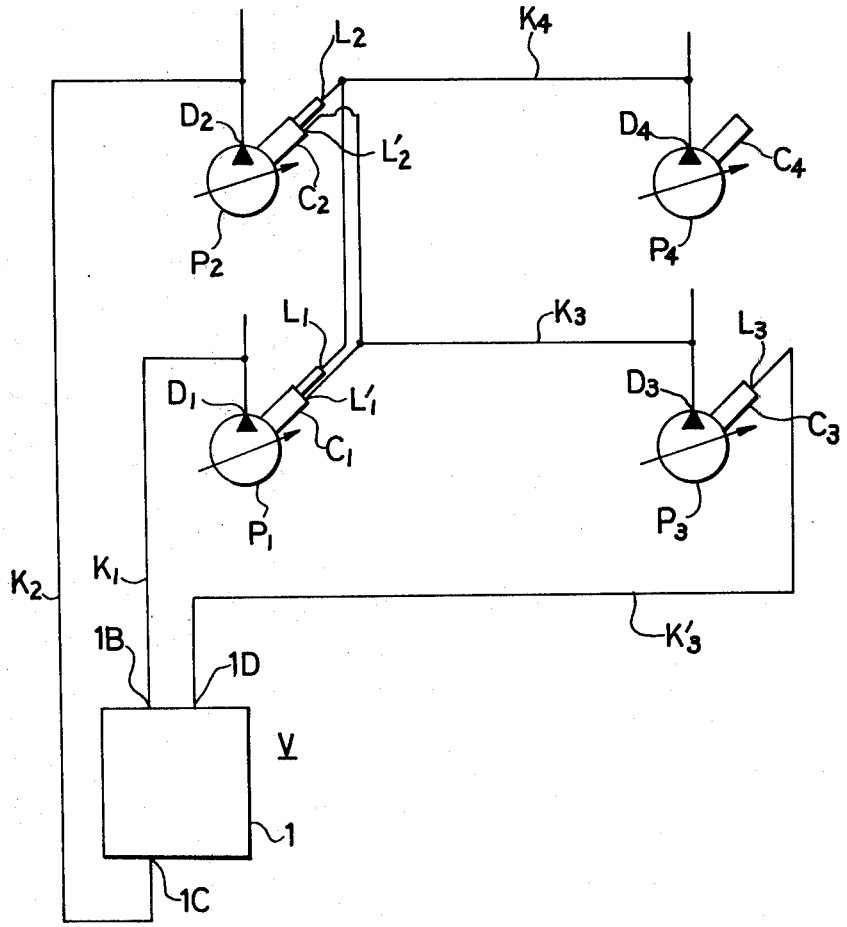

In the example shown in FIG. 4, the maximum capacity of the variable volume pumps $P_1$ and $P_2$ is same, while the maximum capacity of the variable volume pumps $P_3$ and $P_4$ is different. However, the latter may be the same in this case. The difference between this example and that shown in FIG. 3 exists in that the channel 1D of the pressure selector valve V is connected through the tubing $K_3'$ only to the pilot port $L_3$ of the tilt control $C_3$ on the pump $P_3$, but note to the tilt control $C_4$ on the pump $P_4$.

Figure 5:
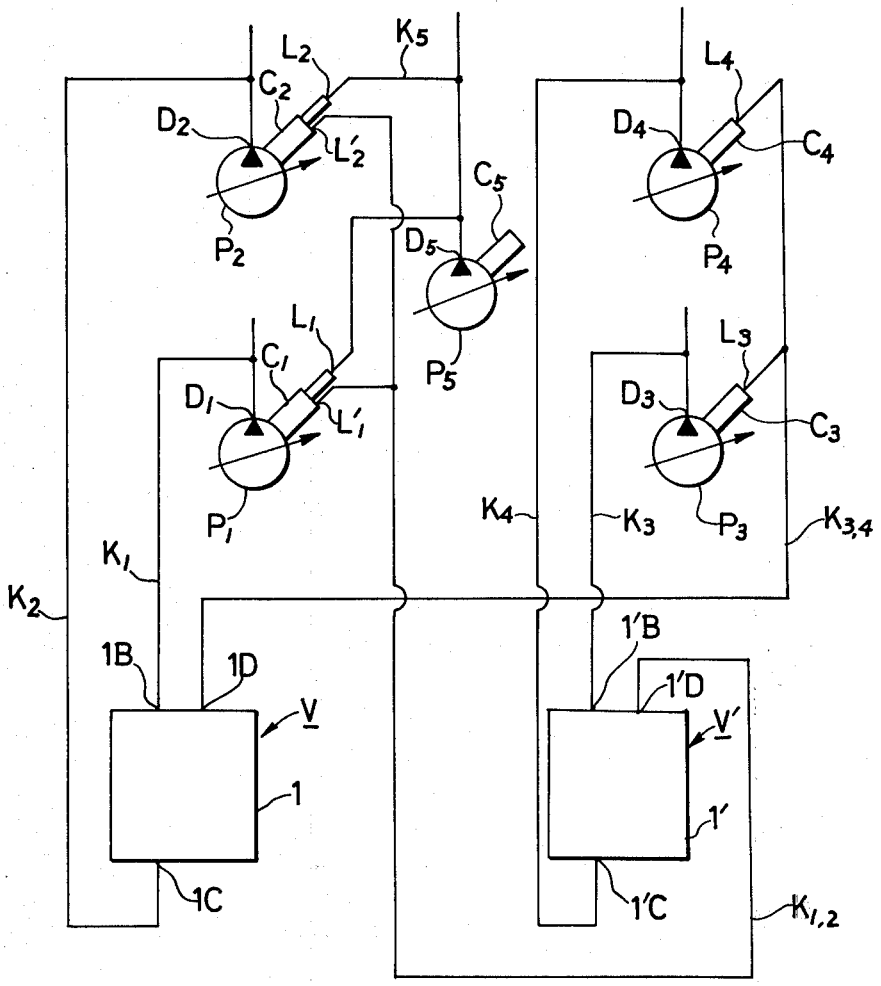

In the example shown in FIG. 5, five variable volume pumps $P_1$, $P_2$, $P_3$, $P_4$ and $P_5$ are involved, wherein the maximum capacity of each pump has the following relation: $P_1=P_2$, $P_3=P_4$, $P_1>P_3$ and $P_3>P_5$ The output pressures of the pump $P_1$ and $P_2$ are fed through the pressure selector valve V via the tubing $K_{3,4}$ to the pilot ports $L_3$ and $L_4$ of the tilt controls $C_3$ and $C_4$, the output pressures of the pumps $P_3$ and $P_4$ are fed through the pressure selector valve V' via the tubing $K_{1,2}$ to the second pilot ports $L'_1$ and $L'_2$, and the output pressure of the pump $P_5$ is fed to the first pilot ports $L_1$ and $L_2$ of the tilt conrols $C_1$ and $C_2$.

In this example, if $P_5>P_1$ and $P_5>P_3$, it is preferable to change the tilt controls $C_3$ and $C_4$ to those of the stepped plunger type shown in FIG. **8*b***, feeding the output pressure of the pump $P_5$ to the respective pilot ports of the tilt controls.

Further, though not illustrated, it is possible to provide another pump $P_6$ in the same relation to the pumps $P_3$ and $P_4$ as the pump $P_5$ to the pumps $P_1$ and $P_2$, to vary the number and the combination of pumps and pressure selector valves, and to use pilot plungers having more than one step.

Figure 7:
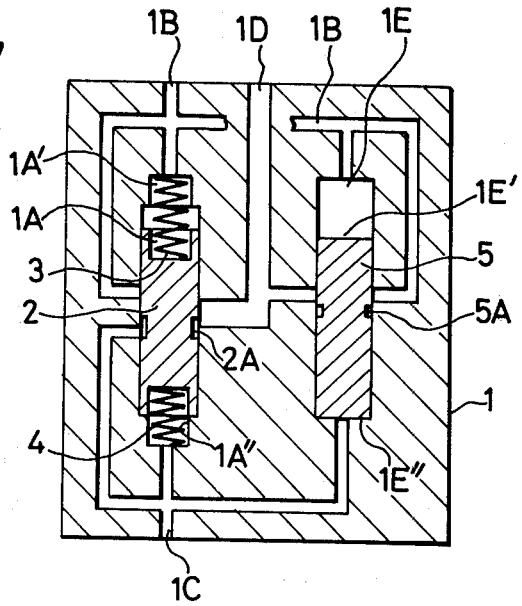
FIG. 7 is a longitudinally-sectioned, side elevational view of another example of pressure selector valves.

Furthermore, the pressure selector valve loses its ability to pick up the lower pressure at approximately the neutral position where the slot 2A underlaps the passages 1B and 1C. Therefore, in order to solve the problem, the slot 2A may be made to zerolap or overlap the passages by providing another pressure chamber 1E, as showin in FIG. 7, wherein another spool 5 having a slot 5A is arranged to connect either the passage 1B (or 1C) through the slot 5A to the passage 1D whenever the pressure in the upper chamber 1E' equals the pressure in the lower chamber 1E'', the two chambers being formed by the chamber 1E and the spool 5.

Figure 6:
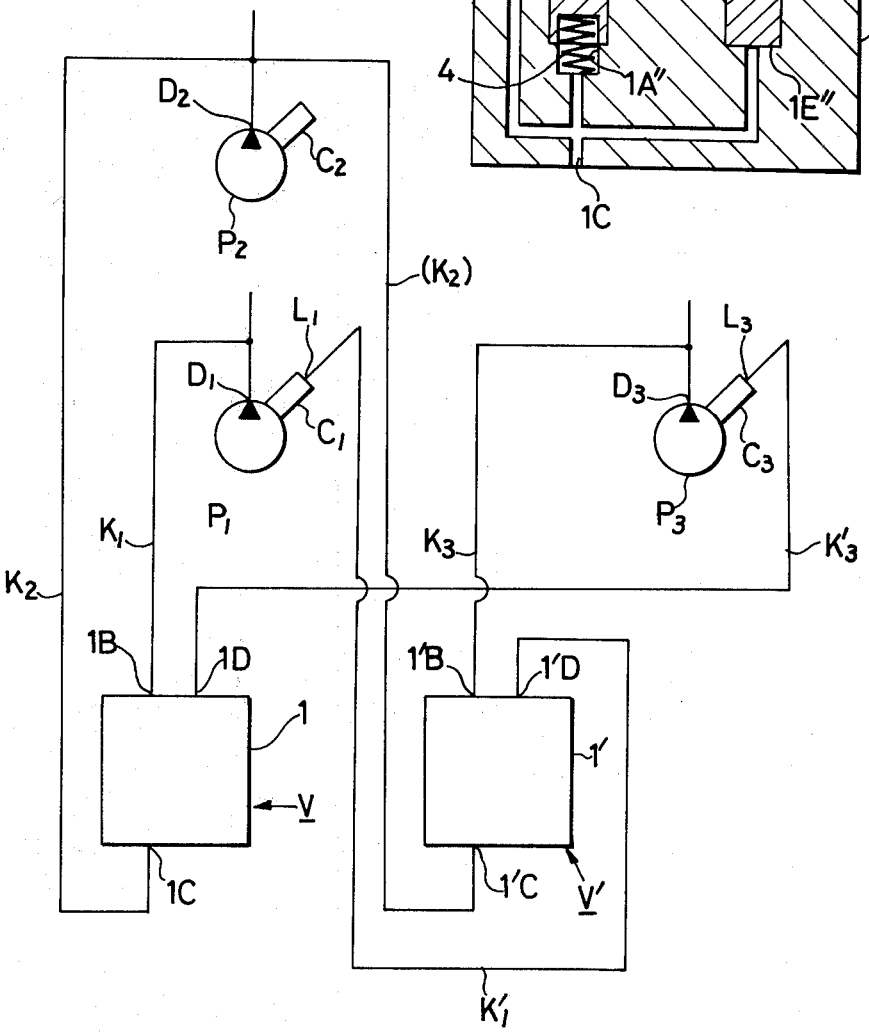

Still further modifications of the invention are possible without any deviation from the basic concept thereof. For example the capacity of the pumps that are said to be the same may be different in such small quantities as not to degrade the actual operation. Also, two pressure selector valves may be used, as shown in FIG. 6, when three pumps of the same capacity are used with their tilt controls having the same power limitation.

The functional effects will now be explained.

Referring once again to FIG. 1, the output pressure of the variable volume pump $P_1$ is fed through the tubing $K_1$ to the passage 1B in the pressure selector valve V, tending to force the spool 2 down against the spring 4 and the pressure in the chamber 1A''. Similarly, the output pressure of the pump $P_2$ is fed through the tubing $K_2$ to the passage 1C, tending to drive the spool 2 up against the spring 3 and the pressure in the chamber 1A'.

The spool 2 moves downward or upward depending on the difference in the output pressures between the pumps $P_1$ and $P_2$, and if there is a distinct difference in the pressures, the spool is moved in either direction to expose the slot 2A to either passage 1B or 1C, the lower pressure being fed through the passage 1D and the tubing $K_3'$ to the pilot port $L_3$ of the tilt control $C_3$ on the pump $P_3$, setting the tilt angle of the tilt control $C_3$.

On the other hand, the output pressure of the pump $P_3$ is fed through the tubing $K_3$ to the pilot ports $L_1$, $L_2$ of the tilt controls $C_1$, $C_2$, setting the tilt angles of the tilt controls $C_1$, $C_2$ respectively.

If there is no distinct difference between the output pressure $P_1$ and $P_2$, then the spool 2 is kept in the neutral position or its vicinity, the slot 2A being exposed to both passages 1B and 1C simultaneously, feeding the mean pressure into the passage 1D.

Now the limit power of the three pumps $P_1$, $P_2$ and $P_3$ is assumed to be 50 hp respectively and the maximum power of the engine is 100 hp. Also the output pressure of the pumps is expressed by $X_1$, $X_2$ and $X_3$, and the consumed power of the pumps then by $W_1$, $W_2$ and $W_3$, respectively.

Also it is assumed in FIG. **8*a*** that the pressure forcing down the plunger $R_3$ counter-balances the compression force of the spring $S_3$, when the pressure is fed to the pilot port $L_3$ by the pumps $P_1$ or $P_2$ operating at 15 hp; the limit power of the pumps $P_1$ and $P_2$ is reduced equally to 35 hp and that of the pump $P_3$ is reduced to 30 hp, when the plunger in each tilt control $C_1$, $C_2$ or $C_3$ reaches its full tranvel position.

As shown in FIG. *9a*, when two of the three pumps $P_1$, $P_2$ and $P_3$ are driven unloaded, 50 hp is available for the third pump. Thus, the engine holds the excess power of 50 hp or more.

As shown in FIG. *9b*, when the pump $P_3$ is driven unloaded, assuming that there is no driving power loss, the other pumps $P_1$ and $P_2$ are not subject to the limitation by the pump $P_3$, being able to run upto 50 hp each.

Figure 9A:
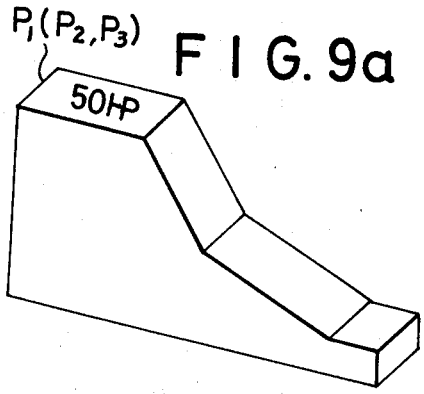
FIGS. 9*a*, 9*b*, 9*c* and 9*d* are pictorial illustrations showing the power allocation of the system illustrated in FIG. 1.
Figure 9B:
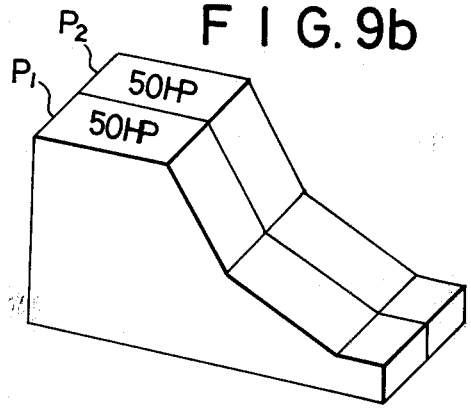
Figure 9C:
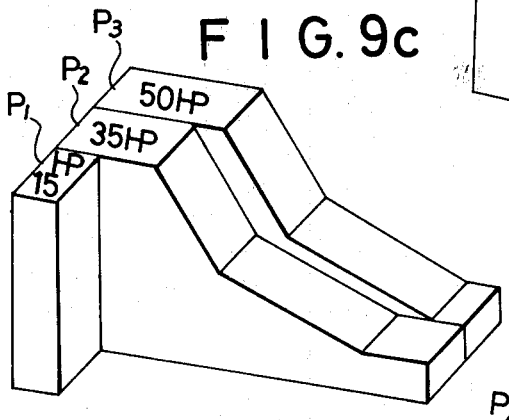
Figure 9D:
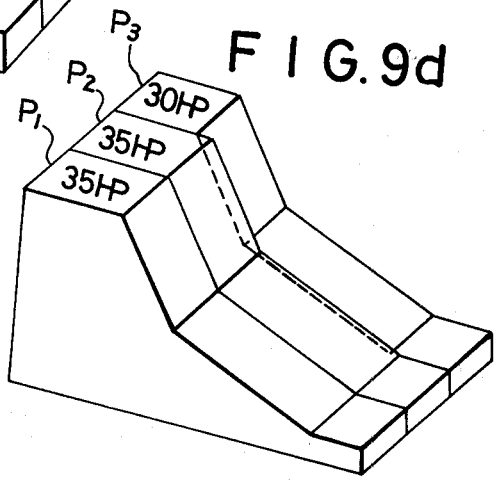

Now referring to FIG. 9C, when the pump $P_1$ is operated below 15 hp, the pump $P_3$ at 50 hp, and the pump $P_2$ above 15 hp, the spool 2 (FIG. 1) in the pressure selector valve is forced to move upwared and the output pressure $X_1$ of the pump $P_1$, which is operated below 15 hp, is fed through the passage 1D to the pilot port $L_3$ on the pump $P_3$.

The condition is now described, referring to FIG. *8a*. The pressure $X_1$ fed into the pilot port $L_3$ tends to press the plunger $R_3$ down. However, since the force of the spring $S_3$ counter-balances the pressure which is built up with the driving power of 15 hp as it is preset, the plunger position is ketp unchanged, allowing the pump $P_3$ to continue running at 50 hp.

On the other hand, the output pressure $X_3$ of the pump $P_3$ is fed to the pilot ports $L_1$ and $L_2$, forcing the plungers $R_1$ and $R_2$ down against the springs $S_1$ and $S_2$ to their full travel positions. The tilt controls reduce the limit power of the pumps $P_1$ and $P_2$ to 35 hp as they are preset.

Therefore, as long as the pump $P_3$ is driven at 50 hp, the power of the pump $P_2$ is limited to 35 hp maximu, and the pump $P_1$ being driven below 15 hp, can be used upto 15 hp.

Now, as shown in FIG. *9d*, if the pump $P_2$ continues to run at 35 hp, and the power of the pump $P_1$ is gradually increased from 15 hp, the output pressure $X_1$ of the pump $P_1$ is kept to be fed to the pilot port $L_3$ since the pressure $X_1$ is still lower than the output pressure $X_2$ of the pump $P_2$, the pressure $X_1$ starting to force down the plunger $R_3$ which was counter-balancing the spring at 15 hp of the pump power, the plunger $R_3$ reaching its full travel position when the consumed power $W_1$ of the pump $P_1$ reaches 35 hp.

That is, while the consumed power $W_1$ of the pump $P_1$ varies from 15 to 35 hp, the consumed power $W_3$ of the pump $P_3$ reduces from 50 to 30 hp as it is preset.

Figure 10A:
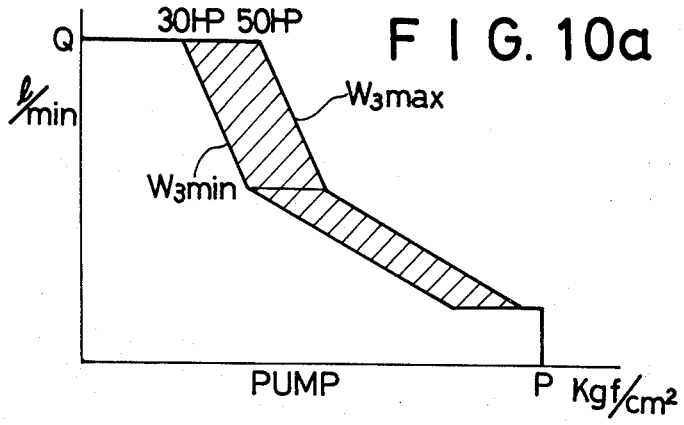
FIG. 10*a*, 10*b* and 10*c* are illustrations showing, respectively, the power control range of each pump illustrated in FIG. 1.
Figure 10B:
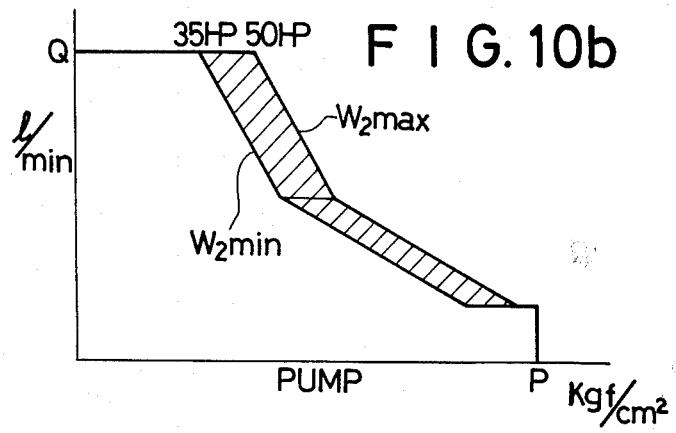
Figure 10C:
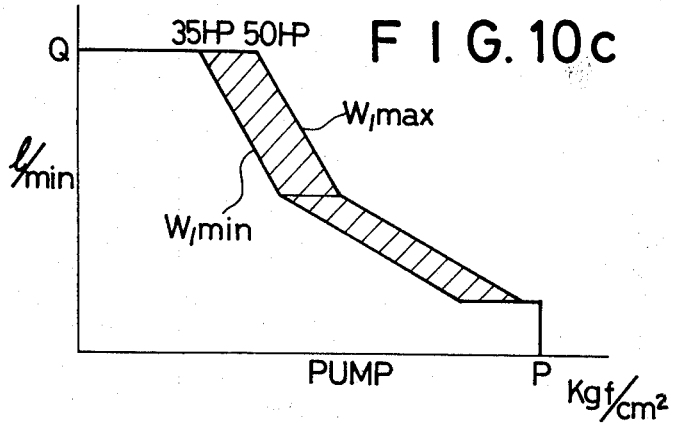

As stated heretofore, each pump, being influenced by the consumed powers of the other pumps, has its limit power adjusted within the limited range shown in FIG. 10, consequently, being driven within the engine maximum power 100 hp. Those conditions are summarized in the following Table 1:

TABLE 1 unit : hp

| | | | | | | |
|---|---|---|---|---|---|---|
| $W_1$ | 50 | 45 | 40 | 35 | 25 | 15 |
| $W_2$ | 50 | 45 | 40 | 35 | 35 | 35 |
| $W_3$ | 0 | 10 | 20 | 30 | 40 | 50 |
| Total | 100 | 100 | 100 | 100 | 100 | 100 |

where $P_1$ or $P_2 \leqq 15 \rightleftarrows P_3 \leqq 50$ $P_1$ or $P_2 = 25 \rightleftarrows P_3 = 40$ $P_1$ or $P_2 \geqq 35 \rightleftarrows P_3 \leqq 30$ In FIG. 2, it is assumed that: the maximum limit power of the pumps $P_1$, $P_2$, $P_3$ and $P_4$ is $W_1$max, $W_2$max, $W_3$max and $W_4$max respectively; the minimum limit power of the pumps is $W_1$min, $W_2$min, $W_3$min and $W_4$min, respectively; $W_1max = W_2max = 60$ hp, $W_3max = W_4max = 50$ hp, $W_1min = W_2min = 50$ hp and $W_3min = W_4min = 30$ hp. It is further assumed that the plungers $R_1(R_2)$ and $R_3(R_4)$ do not start to move until the pilot pressure equivalent to 10 hp is reached, and move to the full travel (minimum power) positions at and above the pressure equivalent to 20 and 30 hp, respectively.

When the maximum power of the engine is 160 hp, the consumed power of each pump is as shown in Table 2, the total power not exceeding the maximum power of the engine 160 hp.

TABLE 2 unit : hp

| | | | | | | | | | |
|---|---|---|---|---|---|---|---|---|---|
| $W_1$ | 60 | 60 | 60 | 55 | 55 | 55 | 50 | 50 | 50 |
| $W_2$ | 60 | 20 | 10 | 55 | 20 | 10 | 50 | 20 | 10 |
| $W_3$ | 30 | 40 | 50 | 30 | 40 | 50 | 30 | 40 | 50 |
| $W_4$ | 10 | 10 | 10 | 15 | 15 | 15 | 30 | 40 | 50 |
| Total | 160 | 130 | 130 | 155 | 130 | 130 | 160 | 150 | 160 |

The basic for the above computation is explained hereinafter.

$W_1$ is controlled between 50 and 60 hp by the loaded power of $W_4$, even when $W_1$ is fully loaded. Similarly, $W_4$ is controlled between 30 and 50 hp by $W_1$. The relation is shown in FIG. *2b*. The values of the limit powers in the control ranges are computed by the following equations:

$$W_1 = W_1\max - \frac{W_1\max - W_1\min}{20 - 10}(W_4 - 10) \quad (1)$$

where $W_1min \leqq W_1 \leqq W_1max$ $$W_4 = W_4\max - \frac{W_4\max - W_4\min}{30 - 10}(W_1 - 10) \quad (2)$$

where $W_4min$ $W_4$ $W_4max$ wherein $W_1$ may be replaced with $W_2$ and $W_4$ may be replaced with $W_3$.

New the smallest of W is set as $W_4 = 15$, thence, from the equation (1), $$W_1 = 60 - \frac{60 - 50}{20 - 10}(15 - 10) = 55$$

Next, the second to the smallest of W is set as $W_2 = 20$, thence, from the equation (2)

$$W_3 = 50 - \frac{60 - 50}{20 - 10}(15 - 10) = 55,$$

thus, result is that $W_1 = 55$, $W_2 = 20$, $W_3 = 40$ and $W_4 = 15$, whcih are the values found in the fifth column of Table 2 counting from the left.

Similarly, if it is $W_2 = 10$, then $$W_3 = 50 - \frac{50 - 30}{30 - 10}(10 - 10) = 50,$$

and, when the smallest W is set as $W_4 = 15$, then $$W_1 = 60 - \frac{60 - 50}{20 - 10}(15 - 10) = 55,$$

thus, the result is that $W_1=55$, $W_2=10$, $W_3=50$ and $W_4=15$, whcih are the values in the sixth column of Table 2 from the left.

Next, set $W_3=W_4=30$, then from the equation (1)

$$W_1 = W_2 = 60 - \frac{60 - 50}{20 - 10}(30 - 10) = 40$$

Although $W_1=W_2=40$ was obtained, $W_1$ must be between 50 and 60 from the condition of the equation (1), then $W_1=W_2=50$. Those are the values in the seventh column of Table 2.

Next, set $W_1=W_2=50$, then $$W_3 = W_4 = 50 - \frac{50 - 30}{30 - 10}(50 - 10) = 10$$

however, from the condition of the equation (2), it must be $W_3=W_4=30$. Those are the values in the eight column of Table 2. The values in the rest of the columns of Table 2 are also calculated in the same manner.

In the system composition shown in FIG. 1, the least powered pump in the pair of the less powered pumps controls the limit power of the other pair of the more powered pumps, of which the less powered pump controls the limit power of the other pump in the pair of the less powered pumps.

Similarly, the input to a pair of pumps is always controlled with selector valves by the pressure from the pump with less power of the other pair in the system, and by the combined pressures of the other pair of pumps in the system and with a preselected combination of pressure selector valve(s) and stepped plunger type tilt control(s).

As used herein, the term minimum limit power Wmin means the minimum value in the range of limit power with the pump being able to run at any power below Wmin.

In FIG. 3 it is assumed that: $W_1max=W_2max=60$ hp; $W_3max+W_4max=100$ hp (it may also be that $W_3max \neq W_4max$); $W_1min=W_2min=50$ hp; $W_3min+W_4min=60$ hp; the engine power is 160 hp; the tilt control does not operate if the total pressure applied to the pilot ports $L_1$ and $L'$, (or $L_2$ and $L'_2$) is under the value equivalent to 40 hp and reaches the minimum limit power position at the pressure equivalent to 60 hp.

The consumed power of each pump in this case is as listed in Table 3, the pumps operating within the maximum power limit of the engine. However, the utilization efficiency is less than that of the example in FIG. 2 (Table 2) because of the less number of pressure selector valves.

TABLE 3 unit : hp

| | | | | | | | | | |
|---|---|---|---|---|---|---|---|---|---|
| $W_1$ | 60 | 60 | 60 | 55 | 55 | 55 | 50 | 50 | 50 |
| $W_2$ | 60 | 15 | 10 | 55 | 15 | 10 | 50 | 15 | 10 |
| $W_3$ | | | | | | | | | 50 |
| | 40 | 40 | 40 | 50 | 50 | 50 | 60 | 80* | — |
| $W_4$ | | | | | | | | | 50 |
| Total | 160 | 115 | 110 | 160 | 120 | 115 | 160 | 145 | 160 |

In FIG. 4, if the same assumptions are applied as in FIG. 3, all values remain same except the asterisked figure which will be changed to 90 hp, provided that the pump $P_4$ is always operable at or over 40 hp.

In FIG. 5, it is assumed that: $W_1max=W_2max=55$ hp; $W_3max=W_4max=40$ hp; $W_5max=20$ hp; $W_1min=W_2min=30$ hp; $W_3min=W_4min=30$ hp; the tilt control $C_1(C_2)$ controls the power by 10 hp at each pressure variation equivalent to 10 hp to the pilot ports $L_1(L_2)$ and $L_1'(L'_2)$; the tilt control $C_3(C_4)$ controls the power by 10 hp at each pressure variation equivalent to 10 hp to the pilot port $L_3(L_4)$; and the maximum power of the engine is 140 hp.

The consumed power of each pump is as shown in Table 4, the total consumed power of the pumps being equal to or below the maximum power of the engine.

TABLE 4 unit : hp

| | | | | | | | | |
|---|---|---|---|---|---|---|---|---|
| $W_1$ | 55 | 50 | 45 | 40 | 35 | 30 | 0 | 0 |
| $W_2$ | 55 | 50 | 45 | 40 | 35 | 30 | 35 | 25 |
| $W_3$ | | | | | | | | 40 |
| $W_4$ | 30 | 40 | 50 | 60 | 70 | 80 | 80 | 40 |
| $W_5$ | | | | | | | | 20 |
| Total | 140 | 140 | 140 | 140 | 140 | 140 | 115 | 125 |

In FIG. 6, the pump $P_2$ is positioned to always operate at the maximum power with no influence from the other two pumps $P_1$ and $P_3$. Thus if one of the other two pumps approaches closer to the maximum power, the remaining pump gets closer to no load, wherein one pump runs at no load and the other two pumps operate at the full load (the maximum power). In the example in FIG. 1, such combination is impossible because the pumps $P_1$(or $P_2$) and $P_3$ operate at the maximum power, and $P_2$(or $P_1$) operates at no load.

According to the Invention, as discussed heretofore, pressure selector valves are used to control powers of multiple pumps, wherein the lower pressure from two pumps in selected to control other pumps, making it very easy to control the operation of multiple pumps within the maximum power of an engine.

Further, with this arrangement, the number of steps of pilot plungers may be reduced to less than required in the conventional arrangement, the number of required tubes being decreased, the structure of the pressure selector valve becoming as simple as a spool valve so that no part requires high concentricity such as a stepped pilot plunger, thereby assuring high reliability.

We claim:

1. A power control system for multiple pumps including more than two variable volume pumps, at least two of the pumps having the same capacity, all of the pumps being driven by a single engine, the control system comprising a pressure selector valve which is fed with pressure from two of the pumps having the same capacity, the lower pressure selectively picked up by the selector valve being fed to a pilot portion of a tilt control on at least one of the other variable volume pumps and, at the same time, the output pressure of the other pumps being fed to a pilot portion of a tilt control on at least one of said two variable volume pumps having the same capacity.

2. The power control system for multiple pumps according to claim 1, wherein the pumps include at least two variable volume pumps having the same capacity.

3. The power control system for multiple pumps according to claim 1, wherein the output pressure of two variable volume pumps having the same capacity is fed through a pressure selector valve to a pilot portion of a tilt control of one other variable volume pump and, at the same time, the output pressure of the one other pump is fed directly to pilot portions of tilt controls of the two variable volume pumps having the same capacity.

4. The power control system for multiple pumps according to claim 1, wherein the output pressure of the first two variable volume pumps having same capacity is fed through a pressure selector valve to pilot portions of tilt controls of the second two variable volume pumps having same capacity and, at the same time, the output pressure of the second two variable volume pumps is fed through another pressure selector valve to pilot portions of tilt controls on the first two variable volume pumps.

5. The power control system for multiple pumps according to claim 1, wherein the output pressure of the first two variable volume pumps having the same capacity is fed through a pressure selector valve to pilot portions of tilt controls of the second two variable volume pumps that do not necessarily have the same capacity and, at the same time, the output pressure of the second two variable volume pumps is fed directly through other tubing to pilot portions of tilt controls of the first two variable volume pumps having the same capacity.

6. The power control system for multiple pumps according to claim 1, wherein the output pressure of the first two variable volume pumps having the same capacity is fed through a pressure selector valve to pilot portions of tilt controls of the second two variable volume pumps having the same capacity and, at the same time, the output pressure of the second two variable volume pumps having the same capacity is fed through another pressure selector valve to second pilot ports of tilt controls on the first two variable volume pumps and the output pressure of a third variable volume pump is fed directly to each of the first pilot ports of the first two variable volume pumps.

7. The power control system for multiple pumps according to claim 5, wherein the output pressure of one of the second two variable volume pumps is fed directly to the first pilot port of one of the first two variable volume pumps having the same capacity and also to the second pilot port of another one of the first two variable volume pumps having the same capacity and, at the same time, the output pressure of another one of the second two variable volume pumps is fed directly and reversely to the second pilot port of the one of the first two variable volume pumps having the same capacity and also to the first pilot port of the another one of the first two variable volume pumps having the same capacity.

8. The power control system for multiple pumps according to claim 5, wherein the output pressure of one of the second two variable volume pumps is fed directly to each first pilot port of the first two variable volume pumps having the same capacity and, at the same time, the output pressure of another one of the second two variable volume pumps is fed directly to each second pilot port of the first two variable volume pumps having the same capacity.

9. The power control system for multiple pumps according to claim 6, wherein the output pressure of a fourth variable volume pump is fed directly to each first port of the second two variable volume pumps.

10. The power control system for multiple pumps according to claim 1, wherein the output pressure of the other pumps is fed directly to a pilot portion of a tilt control on at least one of the two variable volume pumps having the same capacity.

11. The power control system for multiple pumps according to claim 1, wherein the output pressure of the other pumps is fed through a pressure selector valve to a pilot portion of a tilt control on at least one of the two variable volume pumps having the same capacity.

* * * * *